US008205984B2

(12) United States Patent
Tarnacki et al.

(10) Patent No.: US 8,205,984 B2
(45) Date of Patent: Jun. 26, 2012

(54) WEB PRINTER AND SUPPORT STRUCTURE

(75) Inventors: Thomas Tarnacki, San Diego, CA (US); Spencer Hanson, Escondido, CA (US); Paul Ray, Maple Grove, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 385 days.

(21) Appl. No.: 12/569,319

(22) Filed: Sep. 29, 2009

(65) Prior Publication Data

US 2011/0074898 A1 Mar. 31, 2011

(51) Int. Cl.
*B41J 2/01* (2006.01)
*B41J 25/308* (2006.01)

(52) U.S. Cl. ..... 347/104; 347/8

(58) Field of Classification Search ..... 347/8, 104
See application file for complete search history.

(56) References Cited

U.S. PATENT DOCUMENTS

| | | | | |
|---|---|---|---|---|
| 6,523,921 | B2 * | 2/2003 | Codos | 347/8 |
| 2006/0209152 | A1 | 9/2006 | Baringa et al. | |
| 2011/0043586 | A1 * | 2/2011 | Silverbrook et al. | 347/104 |
| 2011/0149004 | A1 * | 6/2011 | Ray et al. | 347/104 |

* cited by examiner

*Primary Examiner* — Omar Rojas

(57) ABSTRACT

In one embodiment, a web printer includes a base, an arched member detachably supported on the base for supporting a web, and multiple print bars each detachably supported on the arched member. A positioning system is operatively connected between the arched member and the base when the arched member is supported on the base for aligning the arched member to the base. In one embodiment, the web printer also includes a second positioning system operatively connected between each print bar and the arched member when the print bar is supported on the arched member for aligning the print bars to the arched member.

14 Claims, 14 Drawing Sheets

WEB PRINTER AND SUPPORT STRUCTURE

BACKGROUND

The present disclosure relates to web printers that use an arched printing unit in which the printing elements are suspended along an arc over a continuous sheet of printable media. Web printers are commonly referred to as web presses.

DRAWINGS

The same part numbers designate the same or similar parts throughout the figures.

DESCRIPTION

Embodiments of the present disclosure were developed for a new, smaller footprint, digital inkjet web printer that integrates the print engine and the dryer into a single unit. The new web printer may be scaled to different printing requirements by, for example, changing the spacing of the web roller guides or changing the size of the printing arch. To help accommodate such changes, a new detachable printing arch is disclosed that can be accurately positioned (and repositioned) on the base without affecting the overall structure of the printer. A new system for accurately positioning the printing elements on the printing arch is also disclosed. Although embodiments are described with reference to a new digital inkjet web printer, it may be possible to implement embodiments of the disclosure in other web printers. The following description, therefore, should not be construed to limit the scope of the disclosure, which is defined in the claims that follow the description.

As used in this document: "print bar" means a structure that holds the inkjet pens or other printing elements that dispense ink or other marking material on to a web; and "web" means a continuous sheet of printable media.

Inkjet Web Printer

Figure 1:
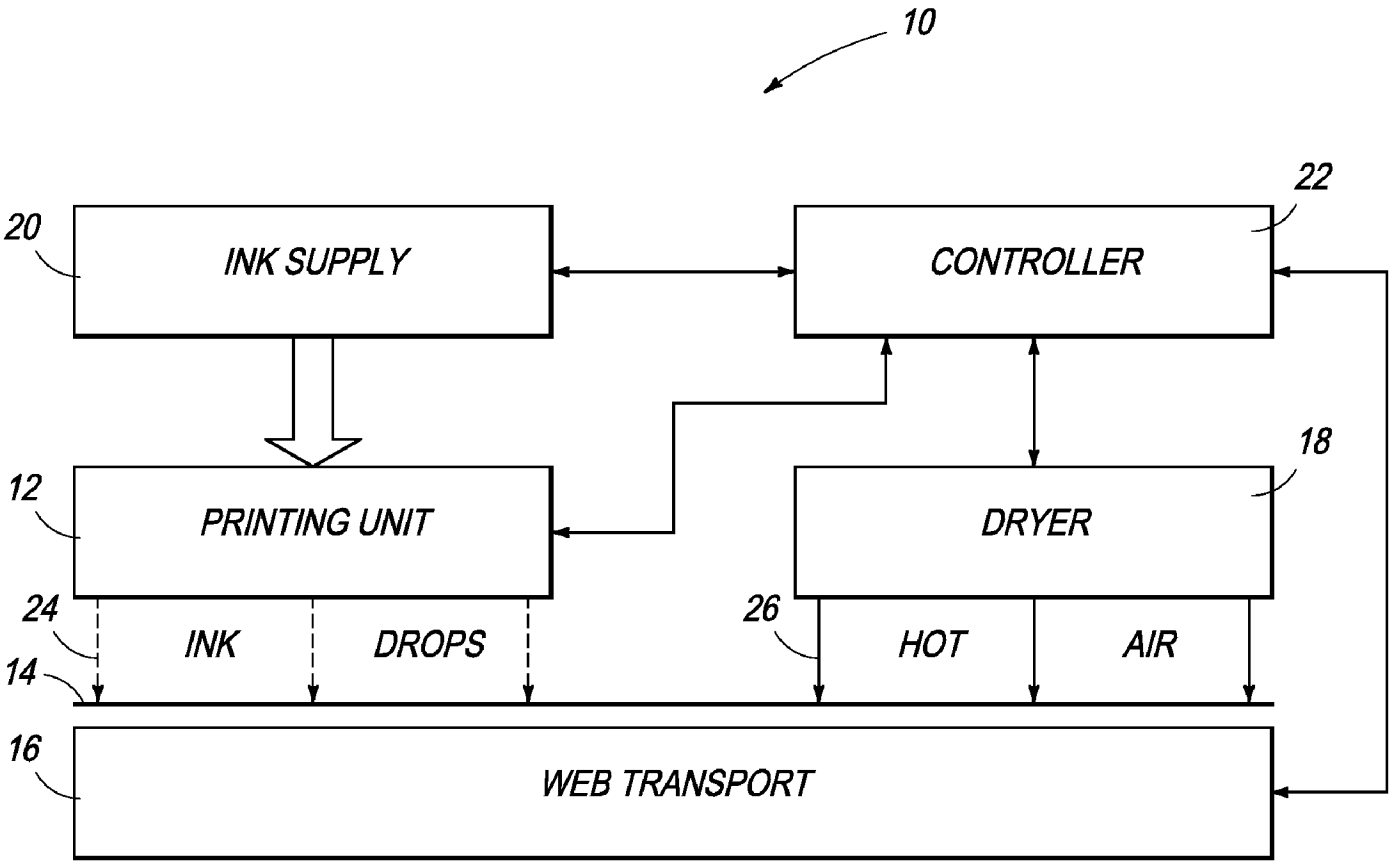
FIG. 1 is a block diagram illustrating one embodiment of an inkjet web printer.

FIG. 1 is a block diagram illustrating one embodiment of an inkjet web printer 10 that includes a printing unit 12 spanning the width of a web 14, a media transport mechanism 16, a dryer 18, an ink supply 20, and an electronic controller 22. As described in more detail below with reference to FIGS. 2-4, printing unit 12 may include a series of print bars arranged in an arch with each print bar holding, for example, an array of ink pens each carrying one or more printhead dies and the associated mechanical and electrical components for dispensing ink drops 24 on to web 14. Also as described in more detail below, dryer 18 may include, for example, a series of perforated tubes for directing hot air 26 onto web 14. Controller 22 represents generally the programming, processors and associated memories, and the electronic circuitry and components needed to control the operative elements of a printer 10. Due to the massive amount of data and signal processing needed in an inkjet web press, controller 22 may include servers and computer work stations as well as central processing units and associated memories (RAM and hard drives for example) and application specific integrated circuits (ASICs).

Figure 2:
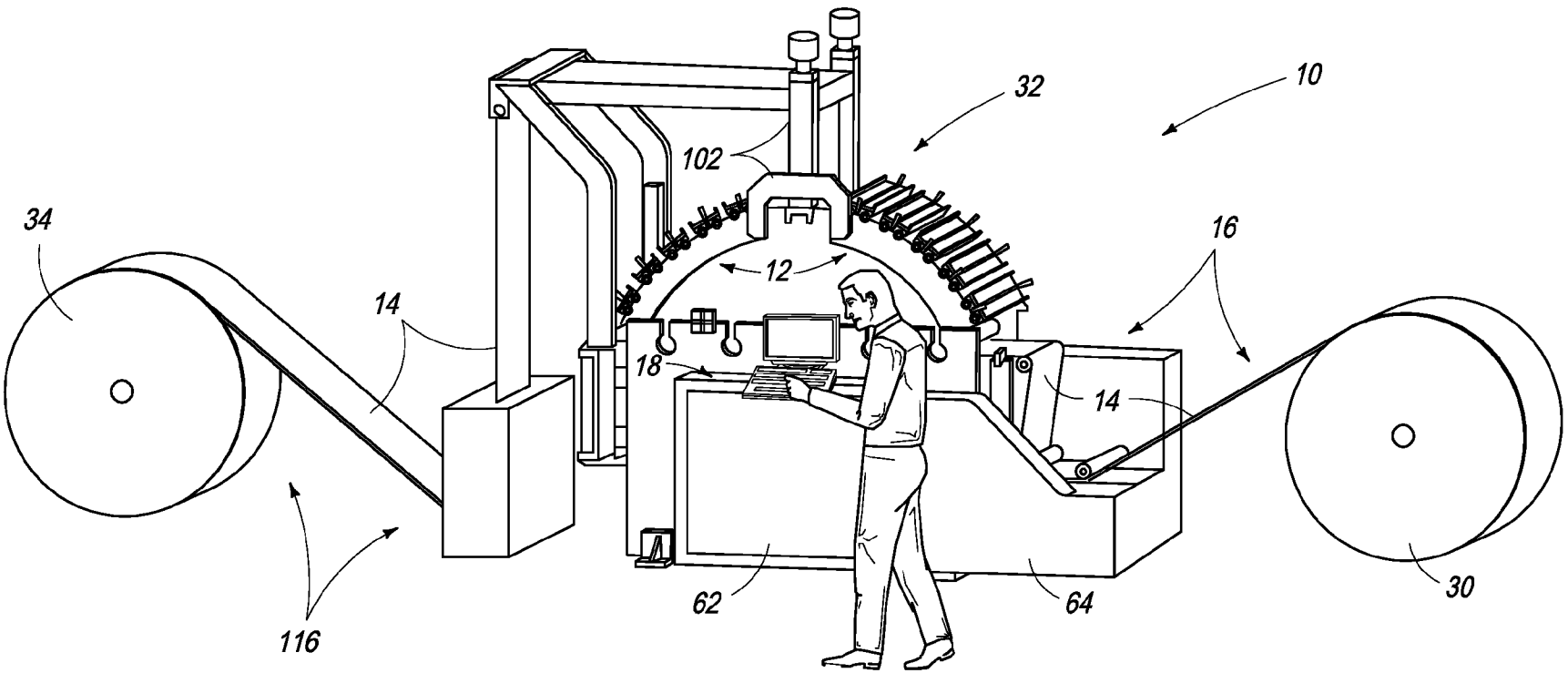
FIG. 2 is a perspective view illustrating a single printing station inkjet web printer according to one embodiment of the disclosure.
Figure 3:
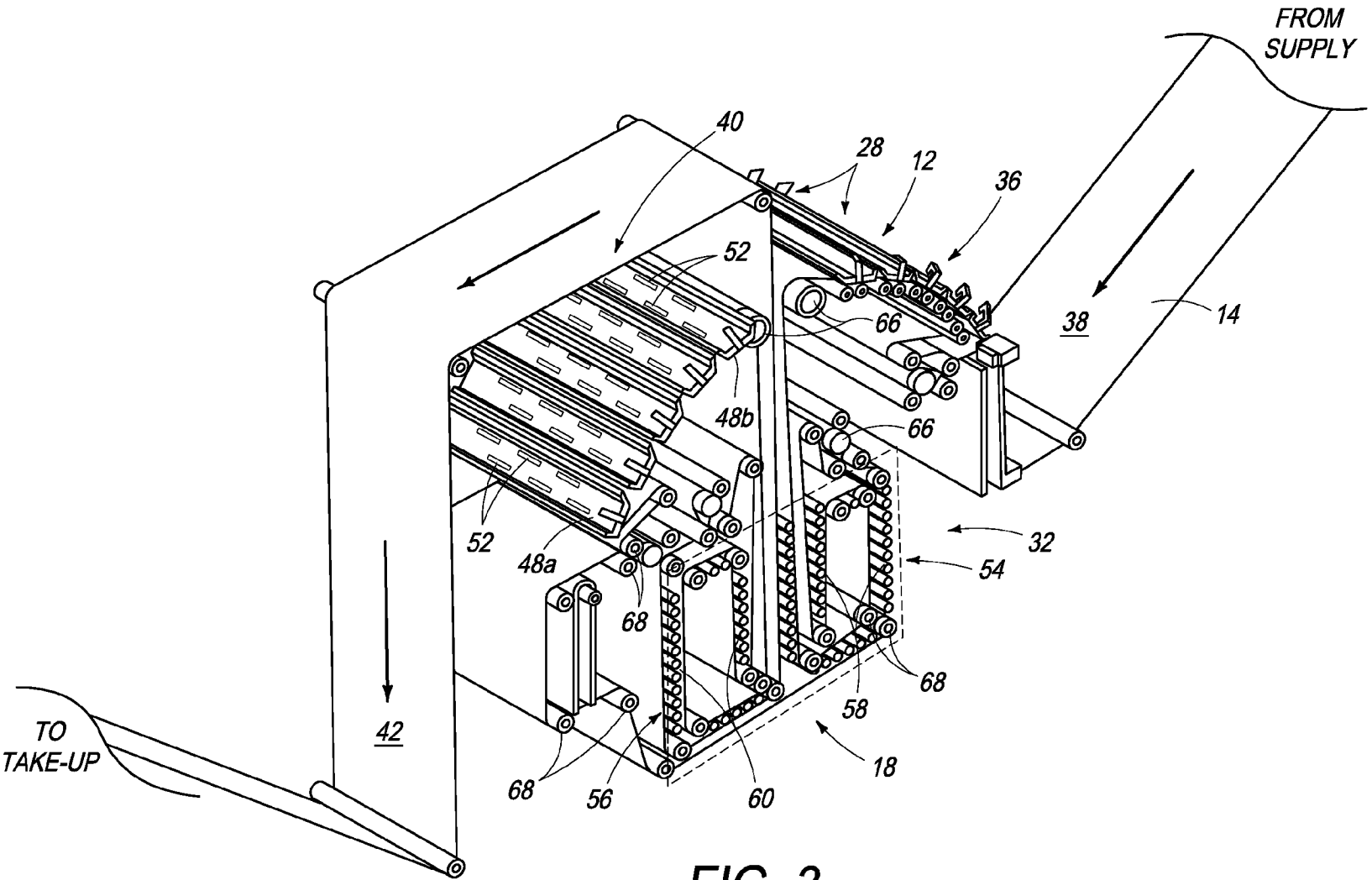
FIGS. 3 and 4 are perspective and elevation views showing in more detail one embodiment of an arched printing station and duplex web printing path in the printer shown in FIG. 2.
Figure 4:
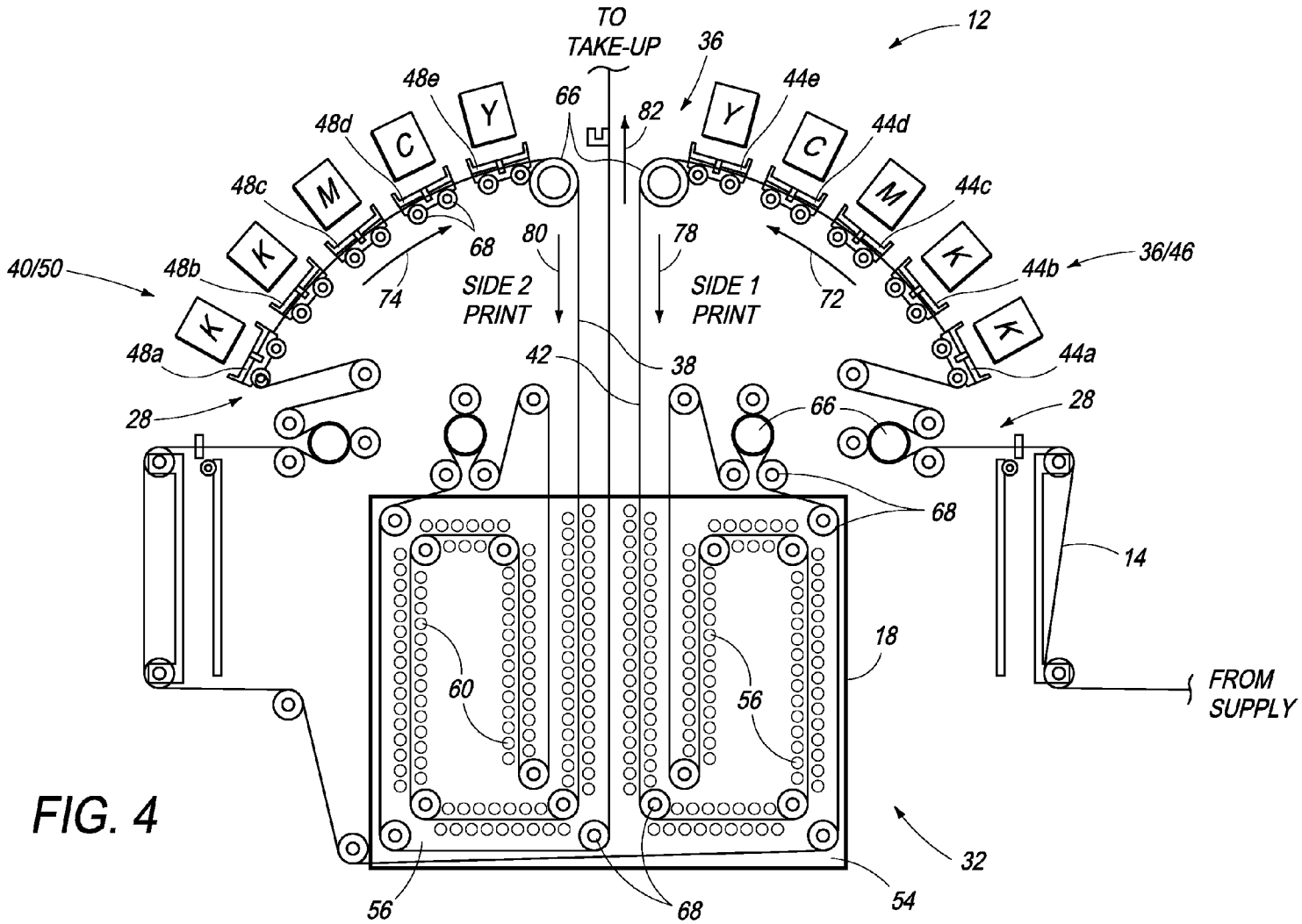

FIG. 2 is a perspective view illustrating a single station inkjet web printer 10 according to one embodiment of the disclosure. FIG. 3 is a perspective view showing in more detail an arched printing unit 12 and a duplex web printing path 28 in the embodiment of printer 10 shown in FIG. 2. FIG. 4 is an elevation view illustrating duplex printing path 28 in more detail. Referring first to FIG. 2, printer 10 includes a web supply spool 30 from which web 14 is fed to a printing station 32 and a take-up spool 34 onto which web 14 is wound after passing through printing station 32. Referring now also to FIGS. 3 and 4, printing station 32 includes arched printing unit 12 and a dryer 18 positioned under and contained within the footprint of arched printing unit 12. Arched printing unit 12 includes a first printing part 36 for printing on a first side 38 of web 14 and a second printing part 40 for printing on a second side 42 of web 14, when web 14 is fed along duplex printing path 28.

First printing part 36 includes a first series of print bars 44*a*-44*e* arranged along an arc on a first side 46 of arched printing unit 12. Second printing part 40 includes a second series of print bars 48*a*-48*e* arranged along an arc on a second side 50 of arched printing unit 12. In one example arrangement, shown in FIG. 4, print bars 44*a*, 44*b*, 48*a* and 48*b* dispense black (K) ink, print bars 44*c* and 48*c* dispense magenta (M) ink, print bars 44*d* and 48*d* dispense cyan (C) ink, and print bars 44*e* and 48*e* dispense yellow (Y) ink. As shown in FIG. 3, each print bar 44, 48 holds a group of ink pens 52. (Ink pens are sometimes also commonly referred to as ink cartridges or printheads.) Ink pens 52 in each print bar 44, 48 are staggered in a lengthwise direction along web 14 and overlap adjacent pens in a crosswise direction across the width of web 14. The configuration of ink pens 52 on each print bar 44, 48 shown in FIG. 3 is just one example. Other configurations are possible. For other examples, each print bar 44, 48 may include a more linear array of printhead dies or one or more printhead modules each holding multiple printhead dies.

Dryer 18 includes a first dryer part 54 for drying web first side 38 and a second dryer part 56 for drying web second side 42. Dryer first part 54 includes a first group of perforated tubes 58 extending across the width of web 14 for directing heated air simultaneously on to both sides 38 and 42 uniformly across the width of web 14. Similarly, dryer second part 56 includes a second group of perforated tubes 60 extending across the width of web 14 for directing heated air simultaneously on to both sides 38 and 42 uniformly across the width of web 14. Some tubes 58 and 60 are omitted from FIG. 3 so as not to unduly obscure web 14 in dryer 18. All of tubes 58 and 60 are shown in FIG. 4. Any suitable perforation(s) in tubes 58 and 60 may be used including, for example, a single lengthwise slit or a pattern of multiple opening. Heated air is pumped into perforated tubes 58, 60, for example, from a source (not shown) that may be integrated into dryer 18 or external to dryer 18. Dryer 18 may be enclosed in a housing 62 (FIG. 2) and air removed from housing 62 through exhaust ducting 64 (FIG. 2).

Air drying allows both sides 38 and 42 of web 14 to be exposed to the heating element (heated air in this case) simultaneously to help speed drying. Also, applying air to both sides 38 and 42 simultaneously helps support web 14 along the spans between web guides. In the embodiment shown in FIGS. 3 and 4, web path 28 includes three vertical spans and two horizontal spans through air distribution tubes 58, 60 in each dryer part 54 and 56. Other configurations are possible, for example depending on the size of dryer 18 and the drying capacity of air distribution tubes 58 and 60 (and any other drying elements that might be used).

Referring still to FIGS. 2-4, a series of guide rollers 66 and 68 are arranged to guide web 14 along duplex printing path 28 from supply spool 30 past first print bars 44*a*-44*e* for printing on web first side 38, then through first dryer part 54 for drying web first side 38, then past second print bars 48*a*-48*e* for printing on web second side 42, then through second dryer part 56 for drying web second side 42, and then to take-up spool 34. In the embodiment shown, web guides 66 are driven rollers that also help move web 14 along path 28, and web guides 68 are non-driven rollers (e.g. idler rollers). Web guides 66 and 68 are arranged to contact only second side 42 of web 14 in dryer first part 54 and only first side 38 of web 14 in dryer second part 56.

Unlike conventional web presses that use a turn bar to invert the web for duplex printing, in duplex printing path 28 the long axis of each web guide 66, 68 is oriented parallel to the long axis of each of the other web guides 66, 68. Web 14 moves past first print bars 44*a*-44*e* along a rising arc in one direction, as indicated by arrows 72 in FIG. 4, and past second print bars 48*a*-48*e* also along a rising arc but in the opposite direction, as indicated by arrows 74 in FIG. 4. Thus, there is no need to invert web 14 on a turn bar for duplex printing, while still realizing the benefits of a smaller footprint, arched printing unit 12. Also, as best seen in FIG. 4, web 14 travels vertically down to dryer 18 from both printing parts 36 and 40 along a center part 76 of arched printing unit 12 between first printing part 36 and second printing part 40, as indicated by arrows 78 and 80. Web 14 exits printing station 32 in the opposite direction (vertically upward) along this same line as indicated by arrow 82. Thus, a dryer 18 for drying both sides 38 and 42 of web 14 may be fully contained within the footprint of arched printing unit 12.

Replaceable Arch and Positioning Systems

Figure 5:
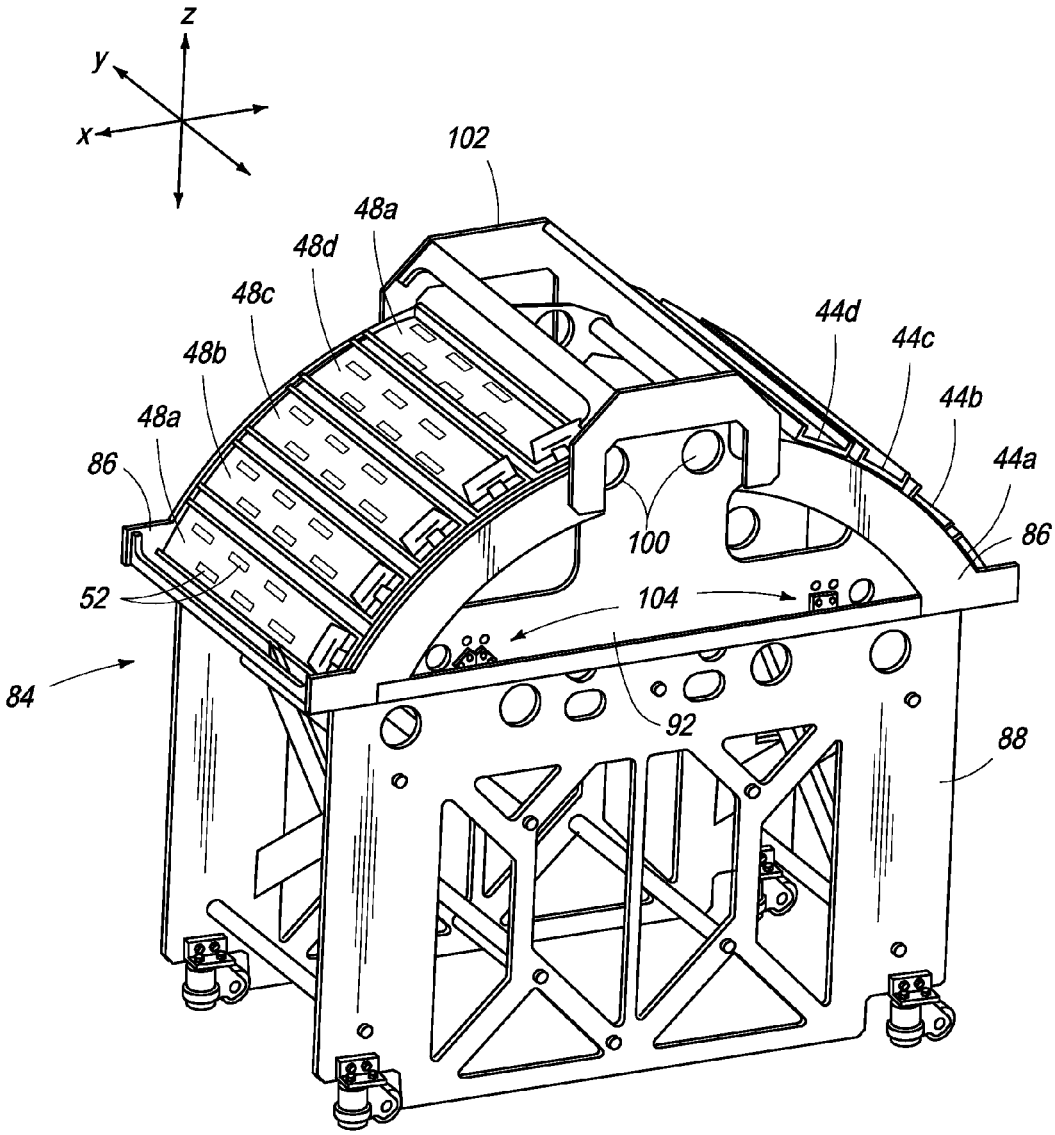
FIGS. 5 and 6 are perspective views illustrating one embodiment of a replaceable arch support and positioning system for the printer shown in FIGS. 2-4. The print bars and lifting plates are removed in FIG. 6 to better illustrate the underlying structures.
Figure 6:
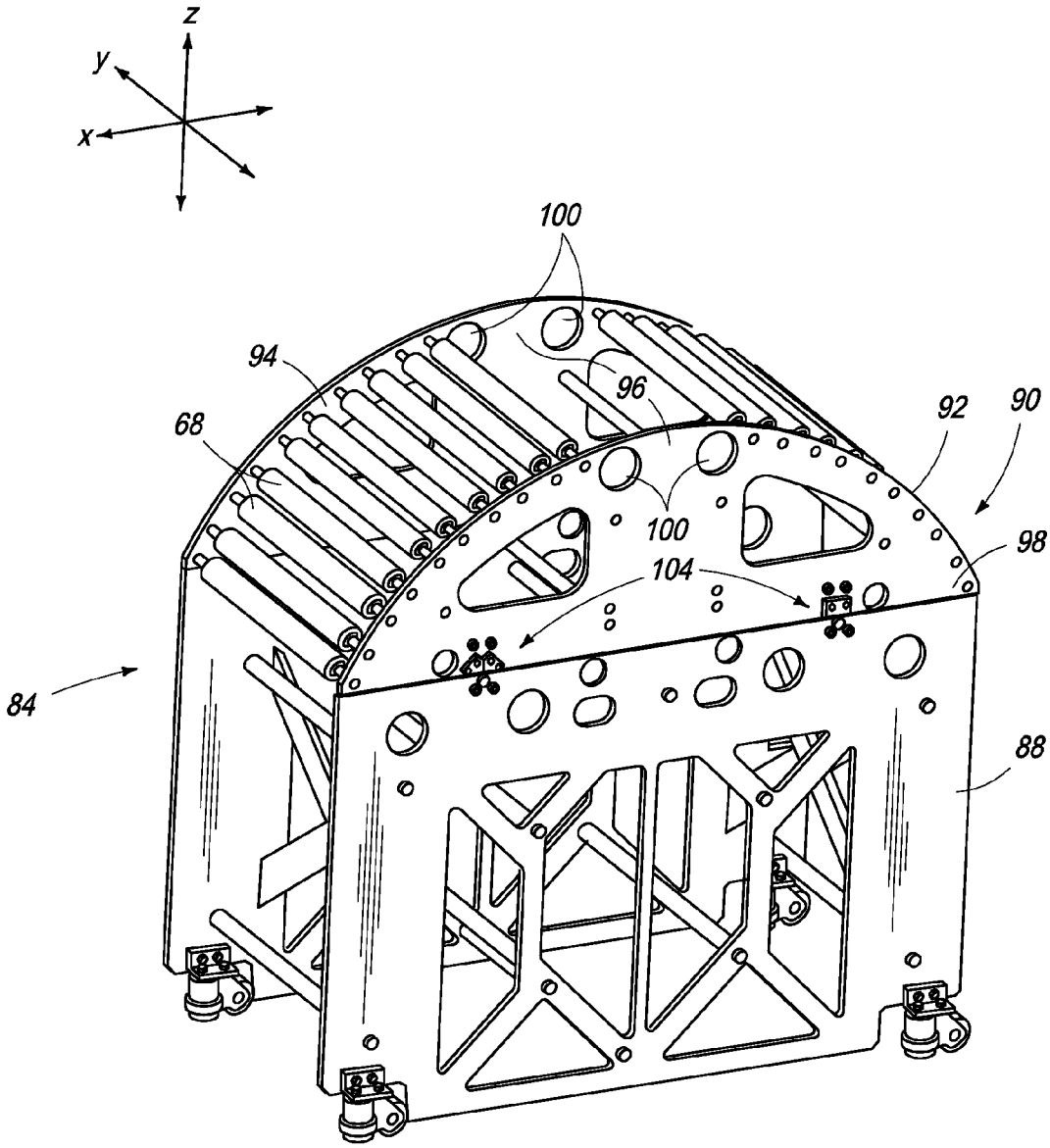

FIGS. 5 and 6 are perspective views illustrating one embodiment of a support assembly 84 for supporting an arched printing unit, such as arched printing unit 12 shown in FIGS. 2-4. Print bars 44 and 48 and lifting plates 86 are removed in FIG. 6 to better illustrate the underlying features of assembly 84. Referring to FIGS. 5 and 6, support assembly 84 includes a base 88 and an arched member 90 supported on base 88. Arched member 90 includes a pair of arched plates 92 and 94 spaced apart opposite one another in the Y direction laterally across web 14 (FIGS. 3 and 4). For convenience, the direction corresponding to a lengthwise direction along web 14 is referred to as the X direction, the direction corresponding to a lateral direction across web 14 orthogonal to the X direction is referred to as the Y direction, and the direction orthogonal to the X and Y directions is referred to as the Z direction, as indicated by the coordinate axes shown in FIGS. 5-13.

With continued reference to FIGS. 5 and 6, each plate 92, 94 includes a first, arced part 96 supporting print bars 44, 48 (FIG. 5) and web guide rollers 66, 68 (FIG. 6) and a second part 98 supporting each plate 92, 94 on base 88. (Only idler rollers 68 are shown in FIG. 6. Circular openings 100 in arced parts 96 for mounting driven rollers 66 are shown in FIG. 6.) In the embodiment shown in the figures, each plate second part 98 forms a straight line extending fully between the two end points of arced part 96 (for example, a chord of a radial arced part 96). Referring specifically to FIG. 5, a lifting plate 86 is positioned on each side of arched member 90 outboard of each plate 92, 94. A tower 102 (see also FIG. 2) and lifting plates 86 are used to lift print bars 44 and 48 on and off arch member 90 for installation, servicing or replacement.

Arched member 90 and base 88 are not formed as an integral unit as in conventional web presses. Rather, arched member 90 is detachable from base 88 to facilitate the replacement of member 90, for example to scale printing unit 12 (FIGS. 2-4) to different printing requirements. To help ensure detachable arched member 90 is properly positioned on base 88 during installation/replacement, support assembly 84 includes a positioning and attachment system 104 for positioning arched member 90 on base 88 and attaching member 90 to base 88.

Figure 7:
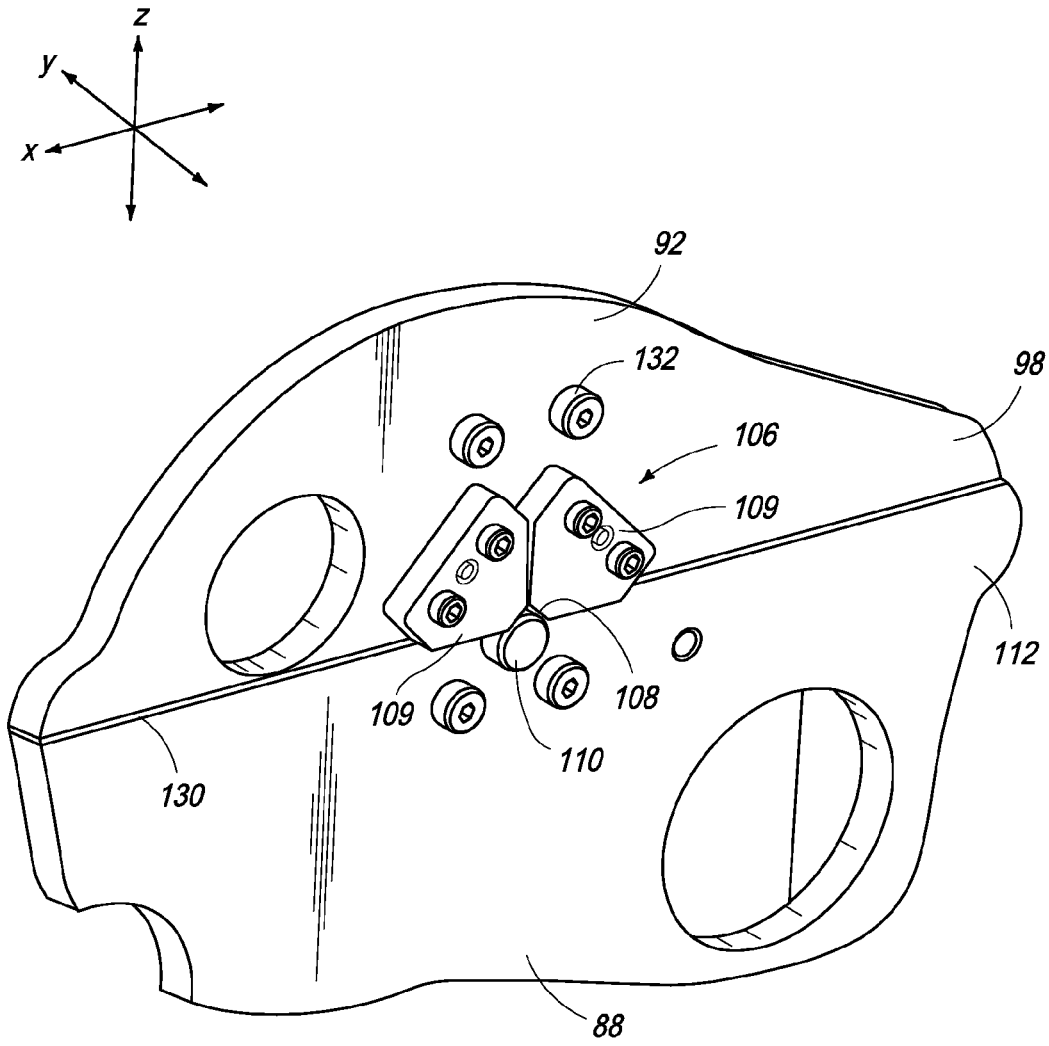
FIGS. 7-9 are perspective views showing the arch support positioning system of FIGS. 5 and 6 in more detail.
Figure 8:
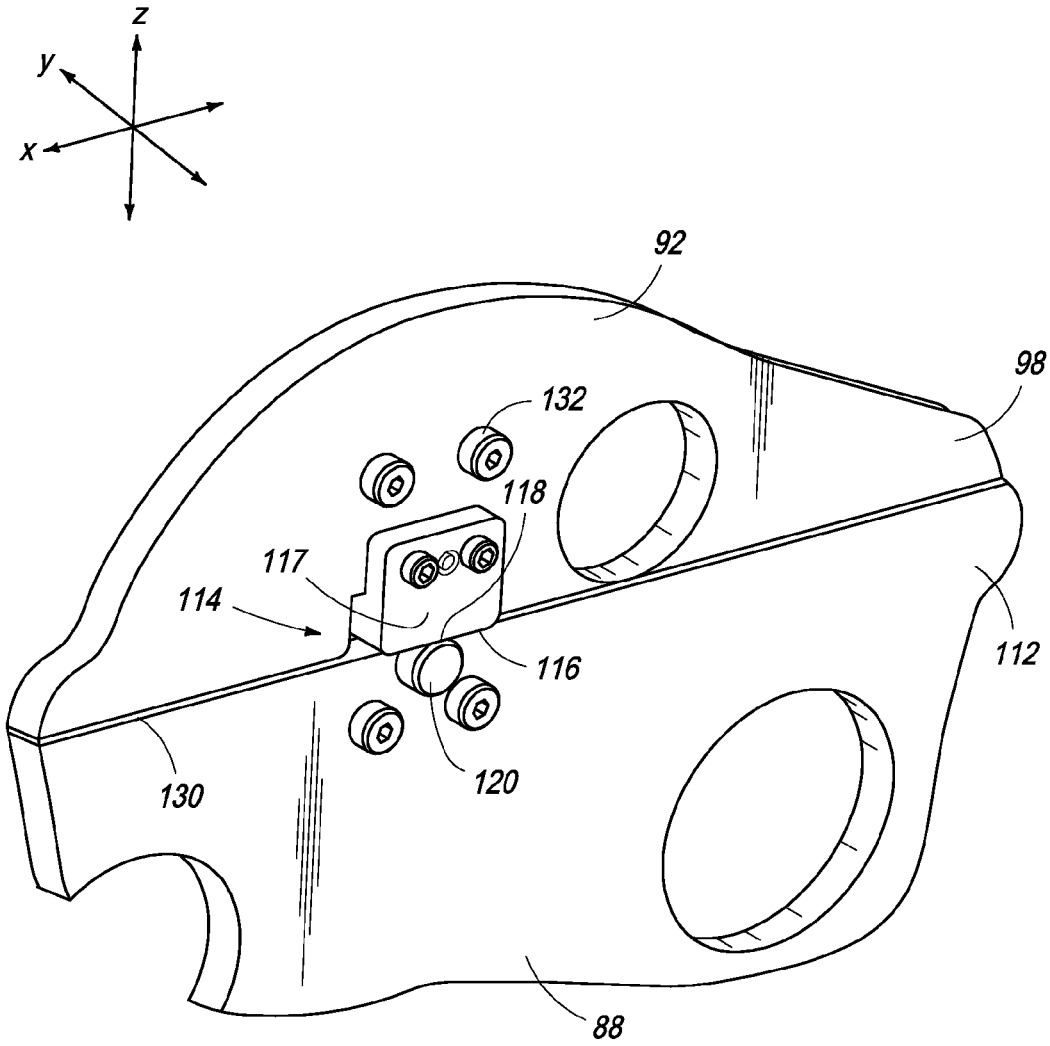
Figure 9:
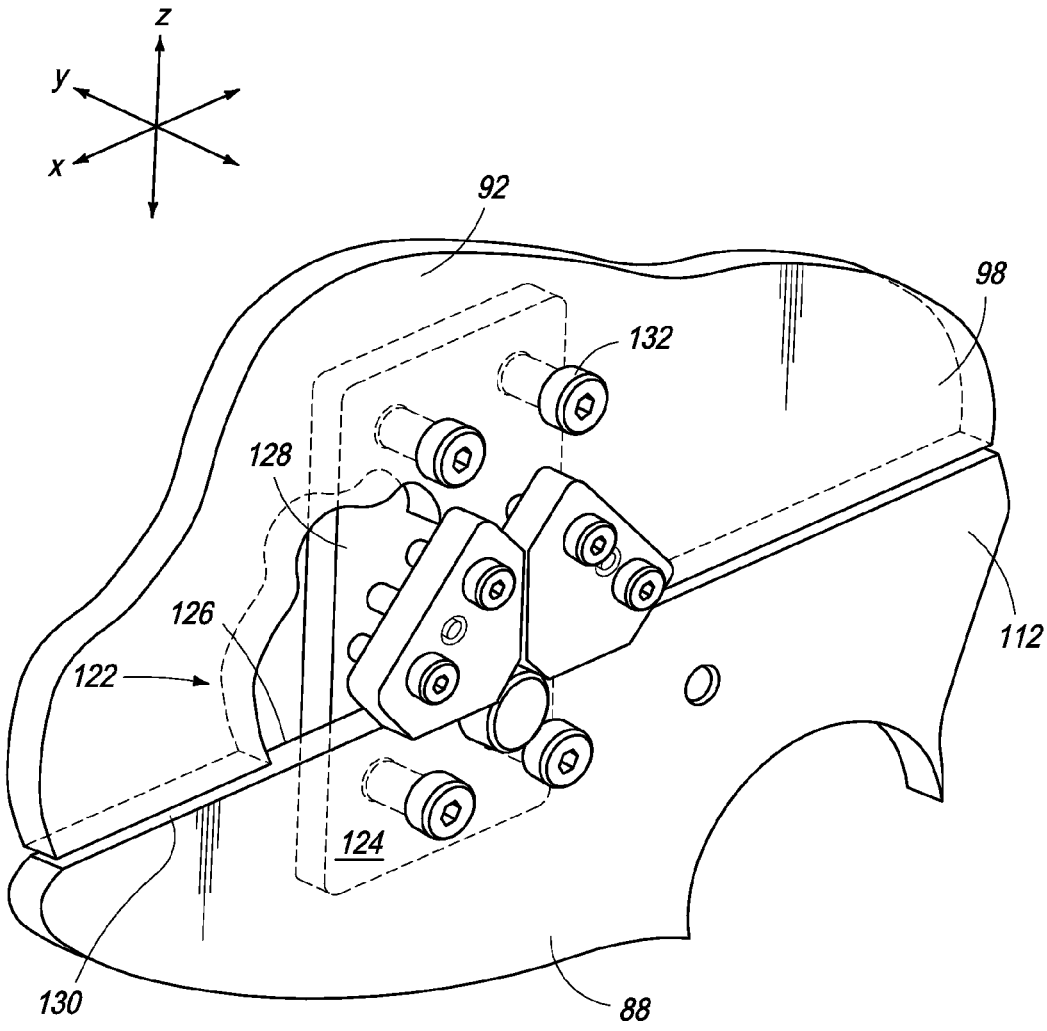
Figure 10:
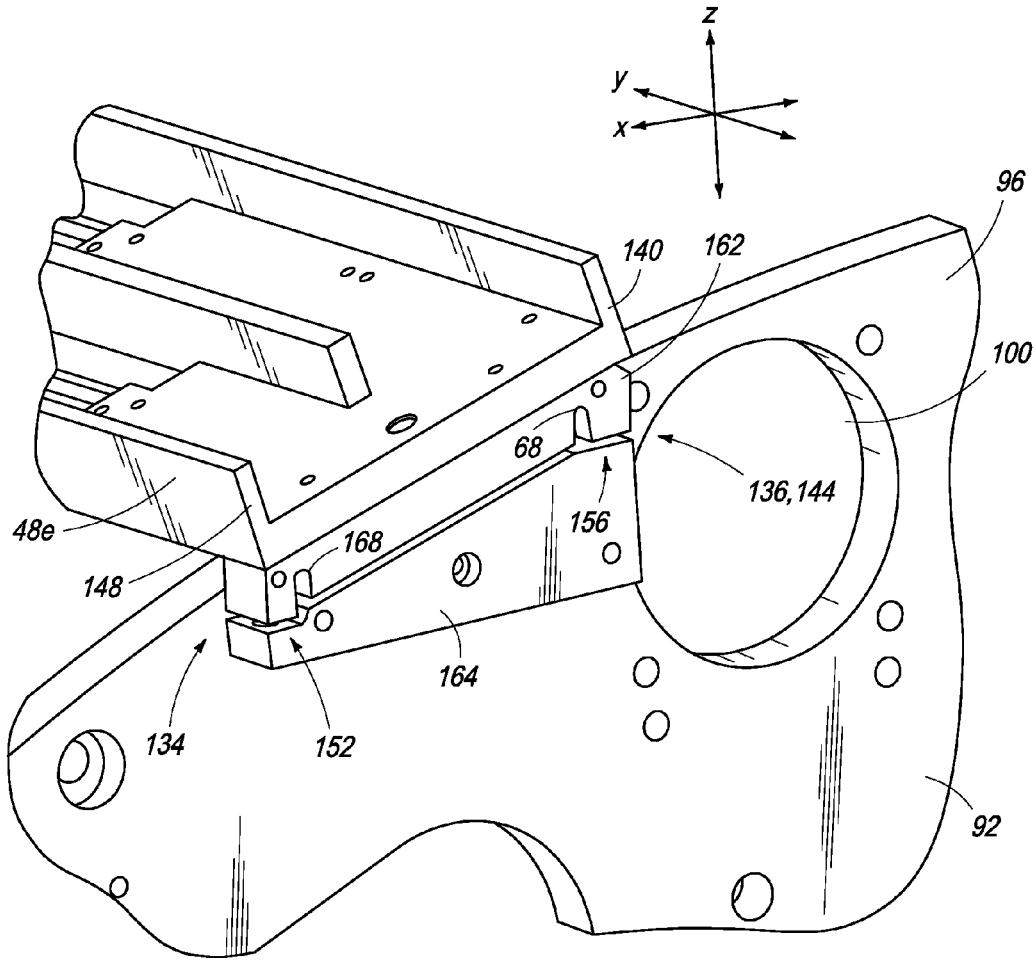
FIGS. 10-14 are detailed perspective views of one embodiment of a system for positioning the print bars on the replaceable arch support shown in FIGS. 5 and 6.

FIGS. 7-9 are perspective views showing the elements of positioning and attachment system 104 in detail. As best seen in FIG. 7, system 104 includes a first positioning element 106 for positioning member 90 relative to base 88 in both the X and Z directions. First element 106 includes a notch 108 in the second part 98 of each plate 92, 94 and a corresponding pin 110 protruding from an upper part 112 of base 88. Pin 110 fits into notch 108 when member 90 is supported on base 88 to constrain movement of member 90 relative to base 88 in the X and Z directions. The two first positioning elements 106 are located opposite one another in the Y direction, although only one first element 106 is visible in the figures. Although a notch 108 in plates 92, 94 and pins 110 on base 88 are shown, the notches could be in base 88 and the pins on plates 92, 94.

As best seen in FIG. 8, system 104 also includes a second positioning element 114 for positioning member 90 relative to base 88 in the Z direction. Second element 114 includes a surface 116 on the second part 98 of each plate 92, 94 and a corresponding surface 118 on base upper part 112. Each plate surface 116 abuts the corresponding base surface 118 when arched member 90 is supported on base 88 to constrain movement of member 90 relative to base 88 in the Z direction. The two second positioning elements 114 are located opposite one another in the Y direction, although only one second element 114 is visible in the figures. As shown in FIG. 6, first and second positioning elements 106 and 114 on each plate 92, 94 are spaced apart from one another toward opposite ends of plate second part 98 for proper Z direction positioning along the full length of each plate 92, 94. Also, to help accommodate thermal expansion along the length of each plate 92, 94, second positioning element 114 does not constrain movement of member 90 in the X direction. In the embodiment shown, base surface 118 is formed as the outer surface of a pin 120 such that surfaces 116 and 118 contact one another along a line (rather than a plane) to minimize frictional surface forces in the X direction.

As best seen in FIG. 9, system 104 also includes a third positioning element 122 for positioning member 90 relative to base 88 in the Y direction. Third element 122 includes a surface 124 on the second part 98 of each plate 92, 94 and a corresponding surface 126 on the inside of base upper part 112. Each plate surface 124 abuts the corresponding base surface 126 when arched member 90 is supported on base 88 to constrain movement of member 90 relative to base 88 in the Y direction. In the embodiment shown in the figures, third positioning element 122 includes a detachable connecting plate 128 that spans the joint 130 between each arched plate second part 98 and base 88. Arched member 90 is attached to base 88 through connecting plate 128, for example with four threaded fasteners 132. Detachable plate 128 may be considered part of the second part 98 of each plate 92, 94 extending surface 124 on plate 92, 94 down to abut surface 126 on base 88, as indicated by the lead lines for part numbers 124 and 126 in FIG. 9. Alternatively, however, detachable plate 128 may be considered part of base upper part 112 extending surface 126 on base 88 up to abut surface 124 on plate 92, 94. In either case, third positioning element 122 aligns each arched plate 92, 94 with base 88 in the Y direction.

In the embodiment shown in the figures, each one of four third positioning elements 122 is located at the same position as each of the first and second positioning elements 106 and 114 to achieve symmetrical geometries and loading conditions. Also, some or all of the parts of each positioning element 106, 114 and 122 on plates 92, 94 (i.e., notch 108 and surfaces 116 and 124) may be detachable from plate 92, 94. For example, in the embodiment shown, each notch 108 is formed between two blocks 109 fastened to the outside of plates 92 and 94 (FIG. 7), each surface 116 is formed along the bottom of a block 117 fastened to the outside of plates 92 and 94 (FIG. 8), each pin 110 and 120 is threaded in to the outside of plates 92 and 94 (FIGS. 7 and 8), and each surface 124 is formed on along the inside of connecting plate 128 fastened to the inside of plates 92 and 94 (FIG. 9). Thus, the above reference to a notch 108 "in" the second part 98 of each plate 92, 94 includes a notch 108 attached to plates 92, 94 as shown in the figures as well as a notch 108 integrated into plates 92, 94. Similarly, surfaces 116 and 124 "on" plates 92 and 94 includes surfaces 116 and 124 attached to plates 92, 94 as well as surfaces 116 and 124 integrated into plates 92, 94. Detachable alignment elements facilitate the use of harder materials for the alignment elements to help minimize deformation at the high stress, contact areas between parts.

Figure 11:
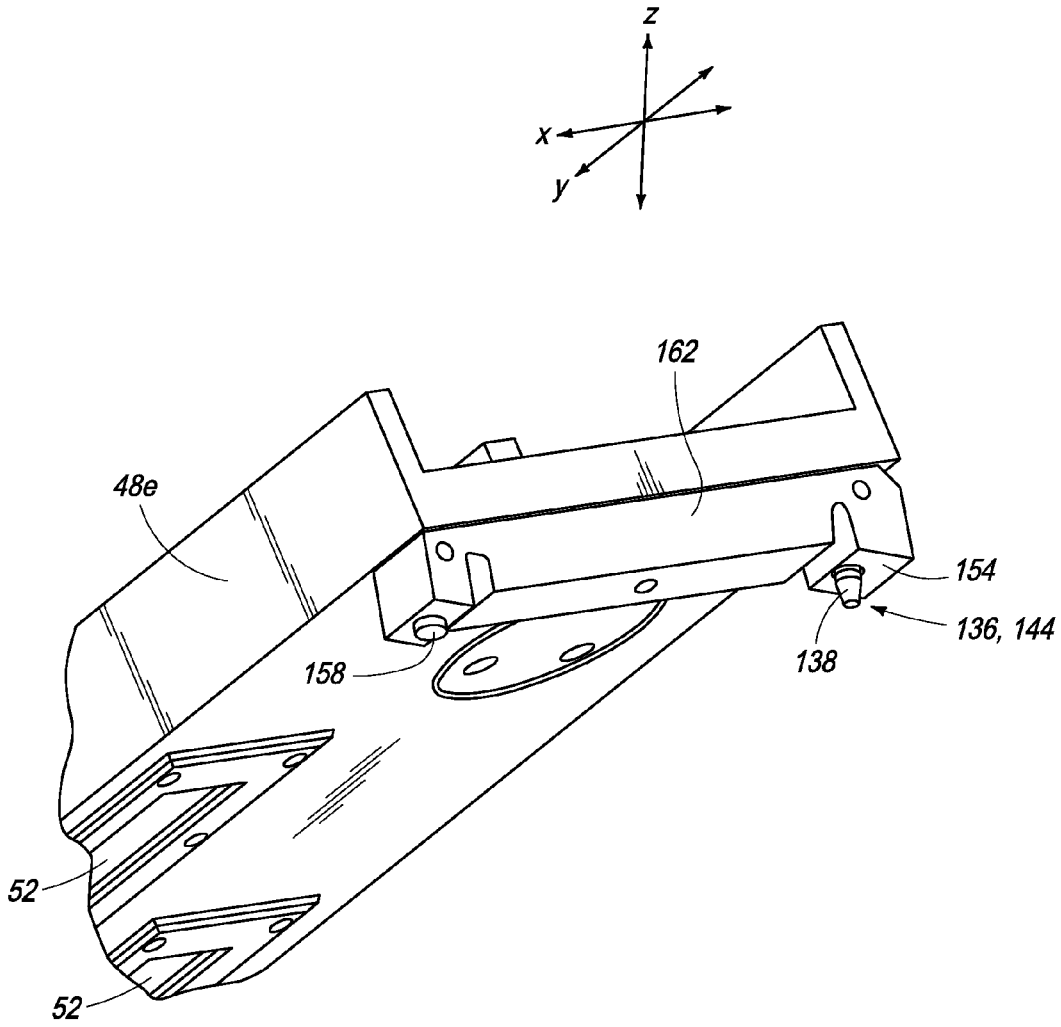
Figure 12:
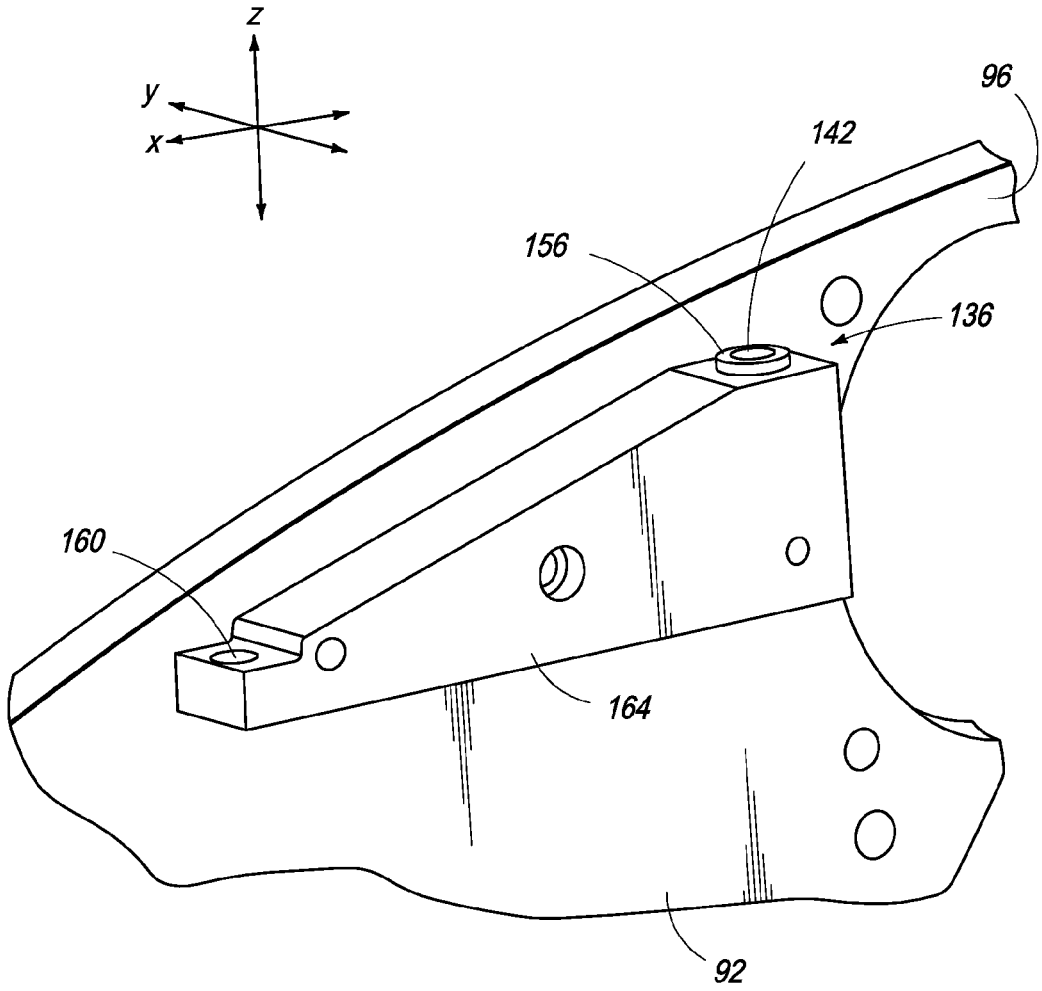

FIGS. 10-14 are detailed perspective views of one embodiment of a system 134 for positioning print bars 44 and 48 (FIGS. 2-5) on detachable arched member 90. For convenience, only one print bar (print bar 48*e*) is shown in FIGS. 10-14 and described below. The same positioning systems components may be used for each print bar 44*a*-44*e* and 48*a*-48*e*. Referring first to FIGS. 10-13, print bar positioning system 134 includes a first positioning element 136 for positioning print bar 48*e* relative to arched member 90 in both the X and Y directions. First element 136 includes a pin 138 protruding from one end of print bar 48*e* and a corresponding hole 142 in first, arced part 96 of one of the arched plates 92 or 94—plate 92 in the embodiment shown (FIG. 12). Pin 138 fits into hole 142 when print bar 48*e* is supported on plates 92 and 94 to constrain movement of print bar 48*e* relative to plates 92 and 94 in the X and Y directions. Although pin 138 protruding from print bar 48*e* and hole 142 in plate 92 is shown, the pin could protrude from plate 92 and the hole could be in print bar 48*e*. A tapered pin 138 may be used to help guide pin 138 into hole 142 in the event of the parts are not precisely aligned during installation.

Figure 13:
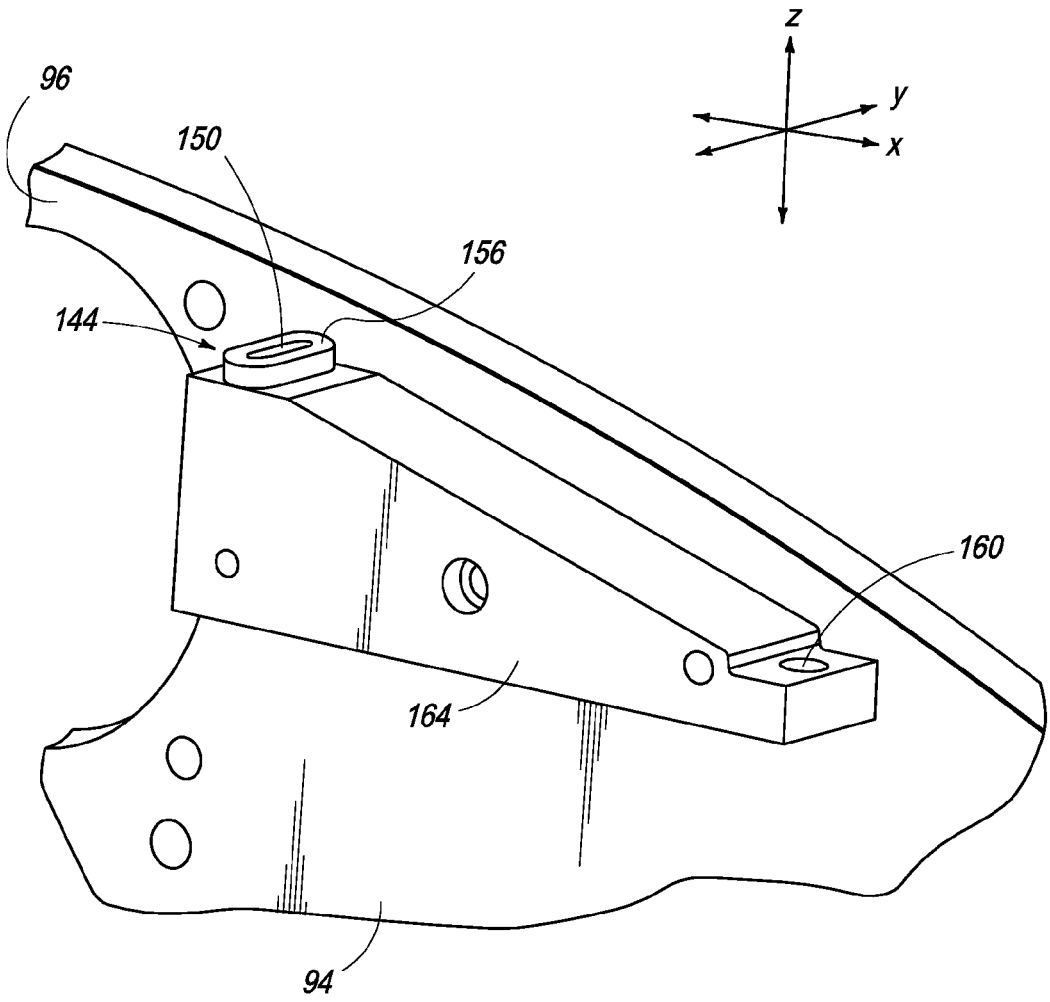

Print bar positioning system 134 also includes a second positioning element 144 for positioning print bar 48*e* relative to arched member 90 in the X direction. Second element 144 includes a pin 138 protruding from the other end of print bar 48*e* and a corresponding slot 150 in first, arced part 96 of the other one of the arched plates 92 or 94—plate 94 in the embodiment shown (FIG. 13). Pin 138 fits into slot 150 when print bar 48*e* is supported on plates 92 and 94 to constrain movement of print bar 48*e* relative to plates 92 and 94 in the X direction. First and second positioning elements 136 and 144 are positioned opposite one another on each end of print bar 48*e* To help accommodate thermal expansion along the length of print bar 48*e*, slot 150 is elongated in the Y direction so that second positioning element 144 does not constrain movement of print bar 48*e* in the Y direction. Although pin 146 protruding from print bar 48*e* and slot 150 in plate 94 is shown, the pin could protrude from plate 94 and the slot could be in print bar 48*e*.

Print bar positioning system 134 also includes a third positioning element 152 for positioning print bar 48*e* relative to arched member 90 in the Z direction. Third element 152 includes two pairs of mating surfaces at each end 140, 148 of print bar 48*e*. The first pair includes a first surface 154 on each end of print bar 48*e* and a mating first surface 156 on each plate first part 96. The second pair includes a second surface 158 on each end of print bar 48*e* and a mating second surface 160 on each plate first part 96. Print bar surfaces 154 and 158 abut corresponding plate surfaces 156 and 160 when print bar 48*e* is supported on plates 92 and 94 to constrain movement of print bar 48*e* relative to plates 92 and 94 in the Z direction. In the embodiment shown in the figures, print bar first surfaces 154 surround pins 138 and 146 and, accordingly, plate first surfaces 156 surround hole 142 and slot 150. Also, the area of surfaces 154-160 may be minimized (small surface areas are shown) to reduce the area that must be machined (or otherwise formed) precisely to provide the correct positioning, of course while still providing sufficient surface area to carry the load of supporting print bar 48*e*.

Figure 14:
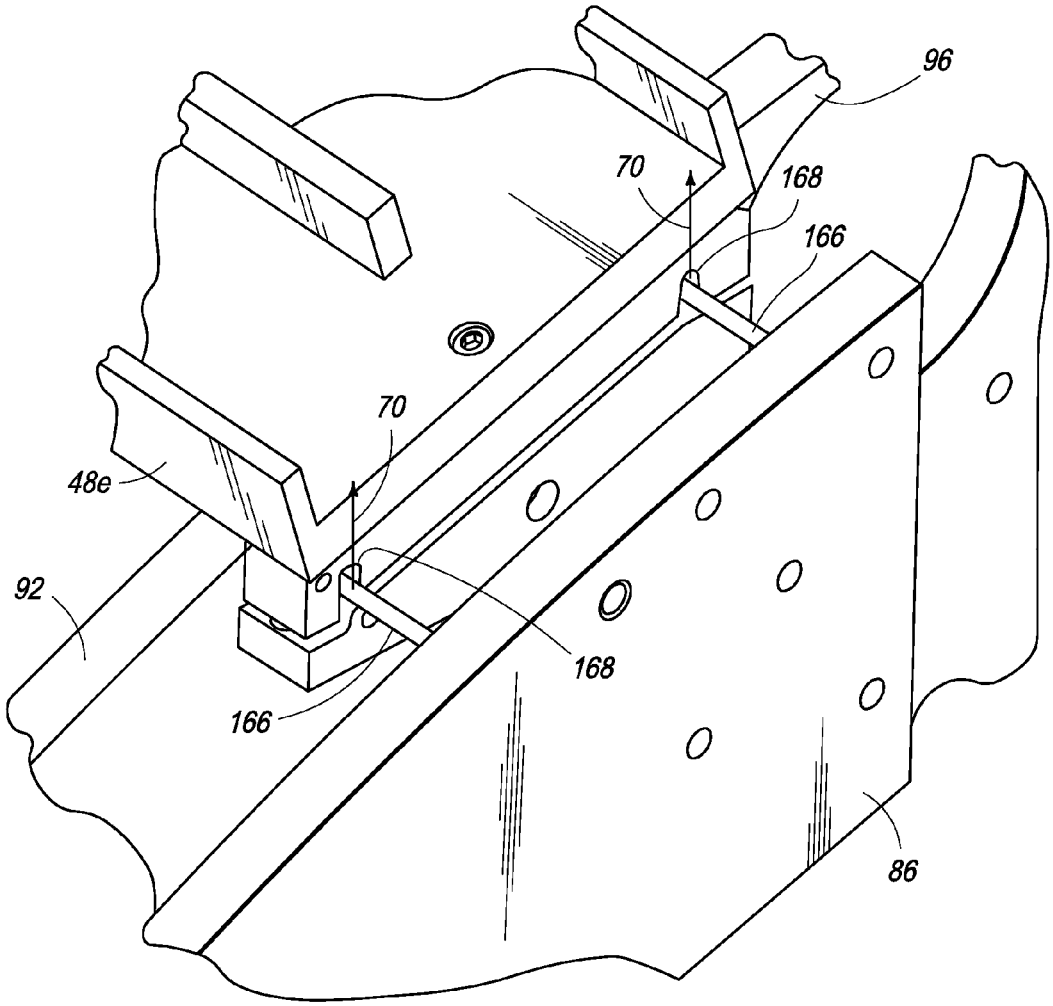

Referring now to FIG. 14, pins 166 protruding from each lift plate 86 extend into corresponding slots 168 in print bar 48*e* for lifting print bar 48*e*, as indicated by arrows 170, for example for servicing or replacing print bar 48*e*.

Pin 138 (and first surface 154) and print bar second surface 158 are spaced apart from one another, for example with pin 138 and second surface 158 each located quite near the sides print bar 48*e* as shown in FIG. 11. Accordingly, hole 142 and slot 150 (and plate first surfaces 156) and plate second surfaces 160 are spaced apart from one another in the same manner. Also, in the embodiment shown, the components of positioning element 136, 144, 152 are detachable from plates 92, 94 and print bar 48*e*, formed for example on blocks 162 attached to print bar 48*e* and blocks 164 attached to plates 92, 94. Thus, the above reference to a pins protruding "from" print bar 48*e*, holes "in" plates 92,94 and surfaces "on" print bar 48*e* and plates 92, 94 includes such parts formed on a block 162, 164 or otherwise attached to print bar 48*e* and plates 92, 94, as shown in the figures, as well as these parts integrated into print bar 48*e* and plates 92, 94.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A web printer, comprising:

a base;

an arched member detachably supported on the base for supporting a web;

multiple print bars each detachably supported on the arched member; and a first positioning system operatively connected between the arched member and the base when the arched member is supported on the base for aligning the arched member to the base; and a second positioning system operatively connected between each print bar and the arched member when the print bar is supported on the arched member for aligning the print bars individually to the arched member.

2. The web printer of claim 1, wherein, when the arched member is supported on the base, the first positioning system constrains movement of the arched member relative to the base in a first direction corresponding to a direction lengthwise along the web when the web is supported on the arched member, in a second direction corresponding to a direction laterally across the web when the web is supported on the arched member, and in a third direction orthogonal to the first and second directions.

3. The web printer of claim 1, wherein, when a print bar is supported on the arched member, the second positioning system constrains movement of the print bar relative to the arched member in the first, second and third directions.

4. A support structure for a web printer, comprising:

a base;

an arched member detachably supported on the base, the arched member having a first, arced part for supporting a web and for supporting one or more printing elements adjacent to the web and a second part for supporting the arched member on the base; and first positioning elements for aligning the arched member to the base, the first positioning elements comprising:

a notch in one of the base or the second part of the arched member and a protrusion from the other of the base or the second part of the arched member, the protrusion fitted in the notch when the arched member is supported on the base to constrain movement of the arched member relative to the base in a first direction and in a third direction orthogonal to the first direction;

a first surface on the base and a first surface on the second part of the arched member that abuts the first surface on base when the arched member is supported on the base to constrain movement of the arched member relative to the base in the third direction; and a second surface on the base and a second surface on the second part of the arched member that abuts the second surface on the base when the arched member is supported on the base to constrain movement of the arched member relative to the base in a second direction orthogonal to the first and third directions.

5. The structure of claim 4, wherein one of the first surfaces comprises a curved surface such that the first surface on the base abuts the first surface on the arched member along a line to constrain movement of the arched member relative to the base in the third direction but not in the first direction.

6. The structure of claim 4, wherein one of the second surfaces is part of a connecting plate spanning a joint between the arched member and the base when the arched member is supported on the base for attaching the arched member to the base.

7. The structure of claim 4, wherein the first direction corresponds to a direction lengthwise along the web when the web is supported on the arched member and the second direction corresponds to a direction laterally across the web when the web is supported on the arched member.

8. The structure of claim 7, wherein:

the arched member comprises first and second arched plates detachably supported on the base, each arched plate having a first, arced part and a second part for supporting the arched plate on the base; and the structure further comprises multiple web guides each supported on and extending between the first, arced part of the arched plates in the second direction for supporting the web between the arched plates.

9. The structure of claim 8, further comprising:

multiple print bars for holding the printing elements, each print bar detachably supported on and extending between the first, arced part of the arched plates in the second direction for detachably supporting the printing elements on the arched member; and second positioning elements for aligning each print bar to the arched plates.

10. The structure of claim 9, wherein the second positioning elements comprise:

for each print bar, a first pin protruding from a first end of one of the print bar or the first part of the first arched plate and a first hole in the first end of the other of the print bar or the first part of the first arched plate, the first pin fitted in the first hole when the print bar is supported on the arched plates to constrain movement of the print bar relative to the arched plates in the first and second directions;

for each print bar, a second pin protruding from a second end opposite the first end of one of the print bar or the first part of the second arched plate and a slot in the second end of the other of the print bar or the first part of the second arched plate, the slot elongated in the second direction and the second pin fitted in the slot when the print bar is supported on the arched plates to constrain movement of the print bar relative to the arched member in the first direction but not in the second direction; and for each print bar, first and second surfaces on each end of the print bar and first and second surfaces on the first, arced part of each arched plate, the first and second surfaces on the print bar abutting a corresponding one of the first and second surfaces on the arched plates to constrain movement of the print bar relative to the arched member in the third direction.

11. The structure of claim 10, wherein a different one of the first surfaces surrounds each of the first pin, the second pin, the hole, and the slot.

12. The structure of claim 4, wherein at least some of the first positioning elements are detachable from the arched member.

13. The structure of claim 10, wherein at least some of the second positioning elements are detachable from the print bars.

14. A web printer, comprising:

a base;

first and second arched plates detachably supported on the base, each arched plate having a first, arced part and a second part for supporting the arched plate on the base;

multiple web guides each supported on and extending between the first, arced part of the arched plates for supporting the web between the arched plates;

multiple print bars each detachably supported along a perimeter of the first part of the arched plates over the web guides;

a first positioning system operatively connected between the arched plates and the base when the arched plates are supported on the base for aligning the arched plates to the base; and a second positioning system operatively connected between each print bar and the arched plates when the print bar is supported on the arched plates for aligning the print bars individually to the arched plates.

* * * * *